United States Patent [19]

Concepcion et al.

[11] Patent Number: 5,029,870

[45] Date of Patent: Jul. 9, 1991

[54] PAINTED GOLF BALL

[75] Inventors: Judy L. Concepcion, New Bedford; Joseph P. Lala, Fairhaven, both of Mass.

[73] Assignee: Acushnet Company, New Bedford, Mass.

[21] Appl. No.: 409,124

[22] Filed: Sep. 19, 1989

[51] Int. Cl.[5] ..... A63B 37/12

[52] U.S. Cl. ..... 273/235 A; 273/220; 260/998.14; 524/908

[58] Field of Search ..... 260/998.14; 524/908; 428/589; 273/235 A

[56] References Cited

U.S. PATENT DOCUMENTS 3,647,221 3/1972 Holley ..... 273/235
4,679,794 7/1987 Yamada et al. ..... 275/235 R
4,679,795 7/1987 Melvin et al. ..... 524/908
4,802,674 2/1989 Kitaoh ..... 273/235 A
4,884,814 12/1989 Sullivan ..... 525/908

OTHER PUBLICATIONS

"Fluorescent Whitening Agent for Plastics and Coatings", Ciba-Geigy, A-181 A3M91, 1981.

*Primary Examiner*—Allan M. Lieberman
*Attorney, Agent, or Firm*—Lucas & Just

[57] ABSTRACT

A white painted balata covered golf ball has two painted layers on top of the outer surface of the cover of the golf ball. The painted layer is made from 100 parts by weight of a white base urethane paint resin with 0.1 parts by weight of a blue agent and 0.04 parts by weight of a violet agent. A top clear coat can be applied on top of the paint layers.

18 Claims, 1 Drawing Sheet

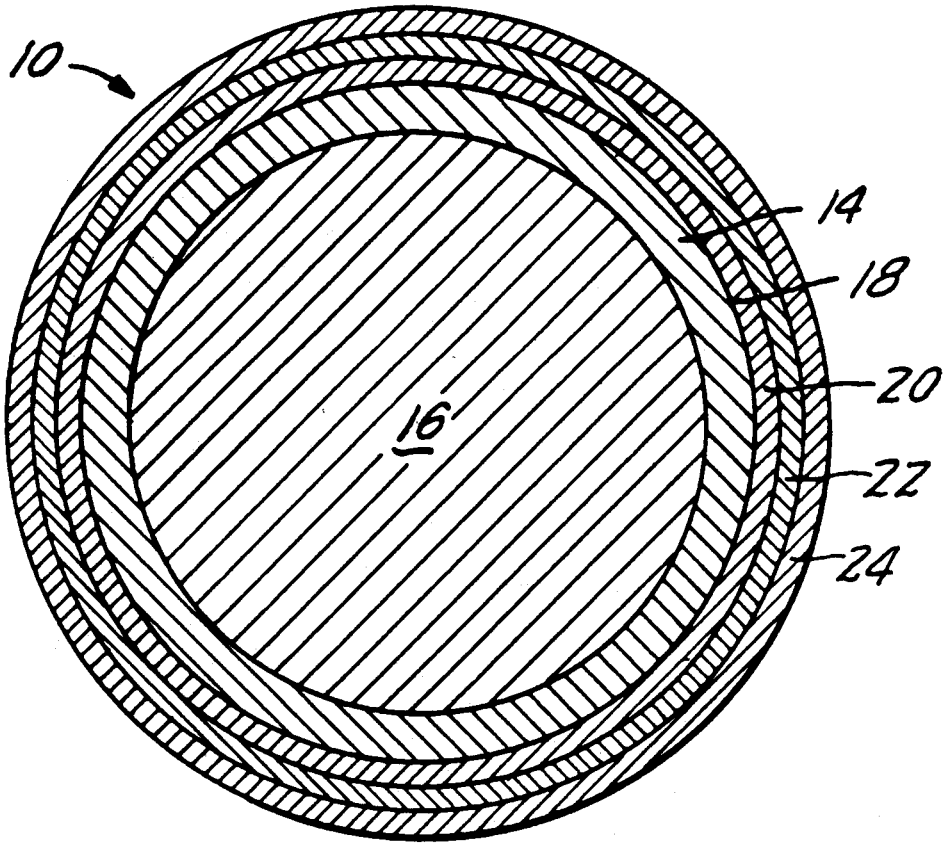
10
14
18
20
16
22
24

PAINTED GOLF BALL

This invention relates to golf balls and, more particularly, to balata covered golf balls and an improved white paint composition used to paint the balata cover of the golf balls.

Conventionally, golf balls are made by molding a cover about a core. The core is either a solid core, solid mass of material, or a wound core, elastic thread wound around a center. The center is either a solid mass of material or a liquid filled envelop which is frozen prior to winding. Golf balls with solid cores are generally referred to as two piece golf balls while golf balls made with wound cores are generally referred to as three piece or wound golf balls. One piece golf balls are made from a homogeneous mass of material.

All three types of golf balls, one piece, two piece and three piece, have an outer surface in which dimples or brambles are formed. Dimples are indentations into the outer surface of the golf ball while brambles are protrusions from the outer surface of the golf ball. Generally, both brambles and dimples are formed on the golf ball to affect the aerodynamics of the golf ball in flight.

Balata was pretty much the standard material used in the industry for golf ball covers until the mid-1960's when E.I. DuPont de Nemours & Co. discovered a new series of resins known as ionomers. These ionomers are sold under the tradename SURLYN®. Balata is a natural resin obtained from trees in South and Central America and is essentially made up of transpolyisoprene. Balata is still used today as a golf ball cover material because of the "click" and "feel" provided by the balata cover to the golfer. "Click" is the sound made by a golf club head when it hits the ball while "feel" is the overall sensation transmitted to the golfer after hitting the ball.

Since at least as early as the 1930's, golf balls were finished by applying a series of layers of paint or the like to the outer surface of the golf ball. Typically, a finishing operation involved applying a first opaque layer to the outer surface of the golf ball, followed by a second opaque layer. The first opaque layer was a primer coat while the second opaque layer was a finishing coat. Conventionally, these opaque layers gave the golf ball a white appearance Typically, the two paint layers were white paint.

After the second opaque layer was applied, identifying indicia, such as a trademark, an identification number, a model number and the like, were stamped onto the ball. Because these stampings were by their nature non-durable, one or two "clear coats" were typically applied on top of the second opaque layer of the golf ball. The clear coat(s) was characterized by being glossy, transparent and free or substantially free of pigment. In addition to protecting the indicia stamped or otherwise affixed to the outer surface of the second opaque layer, the clear coat(s) also imparted a glossy finish to the ball which substantially improved the appearance of the golf ball.

The term "clear coat" or "clear coats" means a coating applied to the second opaque layer of the golf ball, which is transparent and imparts gloss to the ball. The materials applied as clear coats are generally free of pigmentation and have the appearance of water. However, they can contain small amounts of dye or pigment so long as they are still transparent. Clear coat materials are well known in the golf ball art. They are generally either epoxies or urethanes. Where two clear coats are used, the first is usually an epoxy or a one pack urethane and the second is generally a two pack polyurethane, consisting of separate packages of the polyol and the diisocyanate.

In the early 1980's there was introduced to the golf world the concept of colored golf balls, notably of orange color and yellow color. The color was applied as the paint layer between the clear coat(s) and the outer surface of the golf ball. The coloring material was, virtually universally, a paint containing a fluorescent material. Fluorescent materials are species of the generic term optical brightener. The use of fluorescent material in the paint was also applied to the white paint as well as to the colored paint.

After application of the fluorescent paint, white or colored, trademarks and other indicia were stamped in traditional manner and then the golf balls were covered with one or more clear coats as previously described.

More recently, the white and colored paint layer has been eliminated in SURLYN® covered golf balls by adding the fluorescent material and the dye or pigment to the cover stock material itself prior to molding the cover about the core. Balata covered balls are still made conventionally by applying two paint layers between the cover and the clear coat(s).

One of the drawbacks to balata covered golf balls has been their lack of whiteness compared to SURLYN® covered golf balls. There has thus been a need to produce a balata covered golf ball that has a white appearance similar to a white SURLYN® covered golf ball.

It has now been discovered that the addition of a small amount of a blue agent and a small amount of a violet agent to the white paint base resin results in a white paint composition which, when applied to the cover of a balata covered golf ball, produces a golf ball with a very white, bright appearance.

Broadly, a white painted, balata covered golf ball made in accordance with the present invention comprises a core and a cover, on top of said cover a first opaque layer of white paint composition being applied and on top of said first opaque layer a second opaque layer of white paint composition being applied, said white paint composition comprising a white base paint resin, a blue agent and a violet agent, said blue agent and said violet agent being present in an amount sufficient such that the white painted, balata covered golf ball has an "L" reading of between about 85 to about 95, an "a" reading of about −0.5 to about −2.5 and a "b" reading of about −4.0 to about −10.00 when taken on HUNTER LAB COLORIMETER LABSCAN II at D65 with a 2° observation port and 0° illumination, 45° circumferential viewing through optical fibers. Such measurements were made in accordance with ASTM D2244-89. Such a ball has a whiteness index (WI) of about 94 to about 124 when measured in accordance with ASTM E313 dated 1973 (Reapproved 1978). More preferably the "L" reading is between about 86 to about 88.

The white paint composition of the present invention comprises about 100 parts by weight of a white paint base resin; about 0.3 to about 0.03 parts by weight of a blue agent based on 100 parts by weight of said base resin; and about 0.1 to about 0.01 parts by weight of a violet agent based on 100 parts by weight of said base resin. More preferably, about 0.2 to about 0.08 parts by weight of a blue agent is used and about 0.02 to about 0.06 parts by weight of a violet agent is used. Even more preferably, about 0.1 parts by weight of a blue agent with about 0.04 parts by weight of a violet agent is used in the white base resin of the present invention.

The weight ratio of blue agent to violet agent is between about 1.5 to about 4.0 and preferably about 2.5. Maintaining this ratio insures the proper amount of blue and violet agents in the paint composition of the present invention.

In addition to the blue agent and violet agent added to the white paint base resin, other compounds may be added to the white paint composition of the present invention. Specifically, these other compounds can be U.V. inhibitors, flow agents, filler pigments and fluorescent materials or optical brightener.

The white base paint resin is preferably a urethane based liquid having a white pigment therein. Suitably, such white pigments are titanium dioxide, barium sulfate having a particle size of about 0.1 to 0.2 μm aluminum silicate, zinc sulfide, and certain clays. It is preferred to use titanium dioxide. Good results have been obtained with a white base paint resin sold by Midland Dexter under the name 61-701 or 61-352 Urethane Top Coat or 61-800 Urethane Basecoat.

In order to employ this white base paint resin, a thinner and an activator are used. Good results have been obtained using about 36 parts by weight of an activator based on 100 parts by weight white base paint resin. Good results have been obtained with an activator sold by Midland Dexter under the name 62-105 Activator. This activator is a mixture of butyl acetate and ethyl acetate. Good results have also been obtained with 13.4 parts by weight thinner based on 100 parts by weight base resin. Good results have been obtained with a thinner sold by Midland Dexter under the name 2-162 Thinner. This thinner is a mixture of toluene and ethyl acetate.

The blue agent is preferably phthalocyanine blue, ultramarine blue, Miloriblue, iron blue, and cobalt blue. Phthalocyanine blue is preferred. Good results have been obtained with a blue agent from Midland Dexter named Blue Paste 40-1236. This blue paste is a polyol in xylene.

The violet agent is preferably alizarine maroon, 14-4103 Novaperm Red Violet MRS, X-1550 Alizarine Morocco Maroon or Sunfast Violet #23. Good results have been obtained with Violet Paste 40-824 from Midland Dexter. This violet paste is a polyol in toluene.

The term fluorescent agent or optical brightener as used herein is generally the same as that set forth in Kirk-Othmer, *Encyclopedia of Chemical Technology*, 3rd Edition, Volume 4, page 213. As there stated, optical brighteners absorb the invisible ultraviolet portion of the daylight spectrum and convert this energy into the longer-wavelength visible portion of the spectrum. Kirk-Othmer describes typical optical brighteners, including stilbene derivatives, styryl derivatives of benzene and biphenyl, bis(benzazol-2-yl) derivatives, coumarins, carbostyrils, naphthalimides, derivatives of dibenzothiophene-5,5-dioxide, pyrene derivatives, and pyridotriazoles. In accordance with the present invention, any of these or other known optical brighteners may be used, alone or in combination, so long as they are compatible with each other and with the paint composition of the present invention. Examples of specific optical brighteners are derivatives of 4,4'-diamino stilbene-2, 2'-disulfonic acid, 4-methyl-7-diethylamino coumarin and 2,5-bis(5-tert-butyl)-2-benzoxazolyl) thiophene, of which the latter is the preferred optical brightener for use in the present invention.

The amount of optical brightener to be included in the paint composition of the present invention is largely a matter of choice. The amount can range from about 0 parts to .01 parts or more by weight based on 100 parts by weight of white base paint resin.

The white paint composition of the present invention is preferably used as the first and second opaque layer applied to the outer surface of a golf ball.

These and other features of the present invention may be more fully understood with reference to the examples set forth hereinbelow.

EXAMPLE 1

This example illustrates preparation of a paint composition for use on a balata covered golf ball.

TABLE 1

| Parts | Weight (grams) | |
|---|---|---|
| | | FIRST OPAQUE LAYER |
| 100 | 907 | 61-800 Urethane Base Coat |
| 28 | 254 | 62-105 Activator |
| 0.11 | 0.99 | Blue Paste |
| 0.039 | 0.35 | Violet Paste |
| | | SECOND OPAQUE LAYER |
| 100 | 907 | 61-701 Urethane Top Coat |
| 36 | 328 | 62-105 Activator |
| 13.3 | 121 | 2-162 Thinner |
| 0.11 | 0.99 | Blue Paste 40-1236 |
| 0.039 | 0.35 | Violet Paste 40-824 |

All components in Table 1 above were obtained from Midland Dexter.

The accompanying Figure illustrates a golf ball having the paint composition of Table 1 applied thereto. Golf ball 10 has a cover 14 molded around a core 16. The Figure illustrates a solid core making golf ball 10 a two piece golf ball. Core 16 can be a wound core, making golf ball 10 a three piece golf ball. Naturally, if cover 14 and core 16 are of the same material and are homogeneous, golf ball 10 is a one piece golf ball. No matter whether golf ball 10 is a one piece, two piece or three piece, golf ball 10 has an outer surface 18.

Applied to the outer surface 18 is first opaque layer 20. On top of first opaque layer 20, second opaque layer 22 is applied. Layers 20 and 22 comprise the paint composition of Table 1 above. On top of layer 22, a clear coat 24 is applied.

EXAMPLE 2

To illustrate the superior whiteness of a balata covered golf ball made in accordance with the present invention compared to conventional balata covered golf balls, HUNTER LAB COLORIMETER LABSCAN II readings of "L," "a" and "b" were made as set forth below in Table 2:

TABLE 2

| | BALL | L | a | b |
|---|---|---|---|---|
| 1. | Present Invention (Example 1) | 87.01 | −1.66 | −7.75 |
| 2. | Titlest Tour 100 (Balata) | 90.61 | −0.65 | −1.89 |
| 3. | MAXFLI DDH (Balata) | 90.01 | 0.09 | −6.75 |
| 4. | Slazenger (Balata) | 90.06 | 0.21 | −3.25 |
| 5. | 384 Pinnacle Gold (SURLYN ®) | 91.64 | −2.79 | −8.31 |

As can be seen from the results above, the painted, balata covered ball of the present invention had "L," "a" and "b" readings comparable to a high quality SURLYN® covered golf ball wherein the paint pigment is incorporated into the cover stock.

The HUNTER COLORIMETER was operated in accordance with its operating manual or at a D65, 2° observation port, and light hitting the golf ball at 0° angle, 45° circumferential viewing. Such was done in accordance with ASTM D2244-89. The HUNTER COLORIMETER is a conventional piece of equipment manufactured by Hunter Corporation of Reston, Virginia.

A white painted, balata covered golf ball comprises a core and a cover, on top of said cover a first opaque layer of white paint composition being applied and on top of said first opaque layer a second opaque layer of white paint composition being applied, said white paint composition comprising a white base paint resin, a blue agent and a violet agent, said blue agent and said violet agent being present in an amount sufficient such that the white painted balata covered golf ball has an "L" reading of between about 85 to about 95, an "a" reading of about −0.5 to about −2.5 and a "b" reading of about −4.0 to about −10.00 when taken on HUNTER LAB COLORIMETER LABSCAN II at D65 with a 2° observation port and light shining on the golf ball at 0° angle, 45° circumferential viewing in accordance with ASTM D2244-89.

As to any number appearing in the claims which is not modified by the term "about", it will be understood that the term "about" modifies such number.

It will be understood that the claims are intended to cover all changes and modifications of the preferred embodiments of the invention herein chosen for the purpose of illustration which do not constitute departures from the spirit and scope of the invention.

What is claimed is:

1. A painted golf ball having two opaque layers of paint applied to the outer surface of the cover of the golf ball, each said opaque layer of paint comprising:
   - about 100 parts by weight of a white paint base urethane resin;
   - about 0.3 to about 0.03 parts by weight based on 100 parts by weight base urethane resin of a blue agent; and
   - about 0.1 to about 0.01 parts by weight based on 100 parts by weight base urethane resin of a violet agent; wherein the amount of blue agent by weight to the amount of violet agent by weight has a ratio of about 4 to about 1.5; the amount of blue agent and the amount of violet agent being selected to result in the painted ball having an "L" reading of between about 85 and about 95, an "a" reading of between about −0.5 and about −2.5 and a "b" reading of between about −4.0 and about −10.00 when the readings are taken on a Hunter Lab Colorimeter Labscan II at D65 with a 2° observation part and 0° illumination, 45° circumferential viewing through optical filters.

2. The golf ball of claim 1 wherein the golf ball is selected from the group consisting of one piece, two piece and three piece golf balls.

3. The golf ball of claim 1 wherein the blue agent is phthalocyanine blue.

4. The golf ball of claim 1 wherein the violet agent is alizarine maroon.

5. The golf ball of claim 1 wherein about 0.1 parts by weight of blue agent is used and about 0.04 parts by weight of violet agent is used.

6. The golf ball of claim 1 wherein the ball has a balata cover.

7. A painted golf ball having at least one layer of paint applied to the outer surface of the cover of the golf ball, said opaque layer of paint comprising:
   - about 100 parts by weight of a white paint base urethane resin;
   - about 0.3 to about 0.03 parts by weight based on 100 parts by weight base urethane resin of a blue agent; and
   - about 0.1 to about 0.01 parts by weight based on 100 parts by weight base urethane resin of a violet agent; wherein the amount of blue agent by weight to the amount of violet agent by weight has a ratio of about 4 to about 1.5; the amount of blue agent and the amount of violet agent being selected to result in the painted ball having an "L" reading of between about 85 and 95, an "a" reading between about −0.5 and about −2.5 and a "b" reading of between about −4.0 and about −10.00 when the readings are taken on a Hunter Lab Colorimeter Labscan II at D65 with a 2° observation part and 0° illumination, 45° circumferential viewing through optical filters.

8. The golf ball of claim 7 wherein the ball has a balata cover.

9. The golf ball of claim 7 wherein the golf ball is selected from the group consisting of one piece, two piece and three piece golf balls.

10. The golf ball of claim 7 wherein the blue agent is phthalocyanine blue.

11. The golf ball of claim 7 wherein the violet agent is alizarine maroon.

12. The golf ball of claim 7 wherein about 0.1 parts by weight of blue agent is used and about 0.04 parts by weight of violet agent is used.

13. A painted golf ball having two opaque layers of paint applied to the outer surface of the cover of the golf ball, at least one of said opaque layers of paint comprising:
   - about 100 parts by weight of white paint base urethane resin;
   - about 0.3 to about 0.03 parts by weight based on 100 parts by weight base urethane resin of a blue agent; and
   - about 0.1 to about 0.01 parts by weight based on 100 parts by weight base urethane resin of a violet agent; wherein the amount of blue agent by weight to the amount of violet agent by weight has a ratio of about 4 to about 1.5; the amount of blue agent and the amount of violet agent being selected to result in the painted ball having an "L" reading of between about 85 and about 95, an "a" reading of between about −0.5 and −2.5 and a "b" reading of between about −4.0 and about −10.00 when the readings are taken on a Hunter Lab Colorimeter Labscan II at D65 with a 2° observation part and 0° illumination, 45° circumferential viewing through optical filters.

14. The golf ball claim 13 wherein the golf ball has a balata cover.

15. The golf ball of claim 13 wherein the golf ball is selected from the group consisting of one piece, two piece and three piece golf balls.

16. The golf ball of claim 13 wherein the blue agent is phthalocyanine blue.

17. The golf ball of claim 13 wherein the violet agent is alizarine maroon.

18. The golf ball of claim 13 wherein about 0.1 parts by weight of blue agent is used and about 0.04 parts by weight of violet agent is used.

* * * * *

UNITED STATES PATENT AND TRADEMARK OFFICE
CERTIFICATE OF CORRECTION

PATENT NO. : 5,029,870

DATED : July 9, 1991

INVENTOR(S) : Judy L. Concepcion and Joseph P. Lala

It is certified that error appears in the above-identified patent and that said Letters Patent is hereby corrected as shown below:

Column 5, line 57, "part" should read --port--.

Column 6, line 22, "part" should read --port--.

Column 6, line 54, "part" should read --port--.

Signed and Sealed this

Twentieth Day of April, 1993

*Attest:*

MICHAEL K. KIRK

*Attesting Officer*

*Acting Commissioner of Patents and Trademarks*